US005881595A

United States Patent [19]

Sørensen

[11] Patent Number: 5,881,595

[45] Date of Patent: Mar. 16, 1999

[54] METHOD OF MANUFACTURING TUBULAR MEMBER HAVING INTEGRAL EXTERIOR PROTRUSIONS

[75] Inventor: Jens Sandahl Sørensen, Kopervik, Norway

[73] Assignee: Norsk Hydro a.s., Oslo, Norway

[21] Appl. No.: 418,875

[22] Filed: Apr. 7, 1995

Related U.S. Application Data

[63] Continuation of Ser. No. 150,286, Nov. 10, 1993, abandoned, which is a continuation of Ser. No. 884,003, May 18, 1992, abandoned.

[51] Int. Cl.[6] ..... B21C 37/15

[52] U.S. Cl. ..... 72/370.06; 72/370.14; 72/391.2

[58] Field of Search ..... 72/260, 264, 354.6, 72/357, 358, 370, 391.2

[56] References Cited

U.S. PATENT DOCUMENTS

| | | | |
|---|---|---|---|
| 3,087,362 | 4/1963 | Genier | 72/349 |
| 3,436,948 | 4/1969 | Portal et al. | 72/370 |
| 4,598,451 | 7/1986 | Ohki | 72/370 |
| 4,663,812 | 5/1987 | Clausen . | |
| 5,022,135 | 6/1991 | Miller et al. . | |

FOREIGN PATENT DOCUMENTS

| | | |
|---|---|---|
| 1159886 | 7/1958 | France . |
| 2012924 | 3/1970 | France . |
| 101075 | 1/1899 | Germany . |
| 120314 | 5/1901 | Germany . |

*Primary Examiner*—Lowell A. Larson
*Attorney, Agent, or Firm*—Wenderoth, Lind & Ponack, L.L.P.

[57] ABSTRACT

A tubular member having integral exterior protrusions is manufactured by providing a hollow element, for example by extrusion, having therein an axially extending interior defined by a surrounding wall having a thickness varying circumferentially. Such hollow element is positioned within a die that has therein lateral voids. The hollow element within the die is subjected, at the interior thereof, to an axially sequential deformation, for example by sequential penetration through the interior by a mandrel. This results in a non-elastic flow of the material of a thicker portion of the wall in lateral directions thereof into the voids in the die. This results in the hollow element, being formed into a tubular member having on the exterior thereof solid protrusions.

60 Claims, 1 Drawing Sheet

METHOD OF MANUFACTURING TUBULAR MEMBER HAVING INTEGRAL EXTERIOR PROTRUSIONS

This application is a continuation of now abandoned application, Ser. No. 08/150,286, filed Nov. 10, 1993, which is a continuation of now abandoned application Ser. No. 07/884,003, filed May 18, 1992.

BACKGROUND OF THE INVENTION

The present invention relates to a method of manufacturing a tubular member having integral exterior protrusions. The present invention also and more particularly relates to such a method of manufacturing a fluid conduit such as an integrated or integral manifold, for example for use in a heat exchanger, comprising a hollow body having on the exterior thereof a plurality of integral, longitudinally spaced hollow risers.

Integral manifolds, for example for heat exchangers, presently are manufactured by a number of processes. One such known process provides that hollow risers are provided by conducting a deep drawing operation on a sheet of suitable material, for example aluminum sheet material, after which the sheet is bent into the form of a tube and abutting ends of the sheet are welded together. Thus is formed a tube having extending therefrom hollow risers. An obvious disadvantage of this construction is the resultant longitudinally extending welded seam that represents the potential source of leakage under high pressure operation, for example when the welded seam is not a reliably tight and rigid joint. Furthermore, the maximum length of the risers that can be formed is limited by the thickness of the sheet material employed.

This length limitation also applies to a method of fabricating a metallic conduit having exterior surface details as disclosed in U.S. Pat. No. 5,022,135. In this known process, an extruded blank is placed in a high pressure die and is exposed to a pressurized fluid, for example oil, that causes the metal of the blank to flow into cavities of the die, thus forming the exterior surface details.

U.S. Pat. No. 4,663,812 discloses a method of manufacturing an integrated or integral mandrel from an extruded hollow shape or element provided with one or more longitudinally extending solid integral protruding neck portions. From such neck portions are formed a plurality of individual solid risers that subsequently are reshaped into hollow risers by a reverse impact extrusion process. Thereafter, apertures are formed in the wall of the hollow element to communicate the interior thereof with the hollow risers. There are disclosed two different ways of forming the solid risers from the protruding neck part. A first such process involves laterally applying a press tool provided with cylindrical voids. A second method involves the removal of excess material from the neck part by means of a special cutting tool. The first process requires a high pressure to achieve the lateral cold forming process. The second method requires the removal of a substantial amount of material of the neck part and requires a substantial cost to maintain the cutting tool. Additionally, a disadvantage common to both such methods is that a further machining step is necessary to provide a manifold having a smooth surface ensuring a sharply defined transition between the hollow risers and the hollow element.

SUMMARY OF THE INVENTION

Accordingly, it is an object of the present invention to provide a method of manufacturing a tubular member having integral exterior protrusions, whereby it is possible to overcome the above and other prior art disadvantages.

It is a further object of the present invention to provide such a method whereby it is possible to eliminate the need for a machining operation and the resultant wastage of material.

It is a yet further object of the present invention to provide such a method requiring lower capital and maintenance costs and also requiring a lower energy consumption than is possible in the prior art.

It is an even further object of the present invention to provide such a method having greater flexibility with regard to the configuration of the integral exterior protrusions and also whereby it is possible to provide a fluid conduit having an outer surface ready to use without the need for an additional machining and/or process operation.

It is an even more specific object of the present invention to provide an improved method of formation of the tubular member having integral solid exterior protrusions as employed in the above U.S. Pat. No. 4,663,812, but whereby the formation of such member is facilitated substantially.

The above objects are achieved in accordance with the present invention by the provision, for example and preferably by extrusion, of a hollow element having therein an axially extending interior defined by a surrounding wall having a thickness that varies circumferentially of the hollow element. This hollow element is positioned within the interior of a die that has lateral voids communicating with the die interior. The hollow element within the die is subjected, interiorly thereof, to an axially sequential deformation. This can be achieved, in a preferred feature of the present invention, by sequentially forcing a mandrel through the interior of the hollow element, the mandrel having an exterior configuration complementary to a desired interior configuration of the finished tubular member. As a result of this axial sequential deformation, there is caused a non-elastic flow of the material of a thicker portion of the wall of the hollow element, such flow being in directions laterally of the hollow element and into the voids in the die. The sequential forcing or penetration of the mandrel through the interior of the hollow element thus forms the hollow element into the desired tubular member, and the non-elastic flow of the material of the thicker portion of the wall of the hollow element into the voids in the die is achieved axially sequentially and results in the formed tubular member having on the exterior thereof integral solid protrusions.

In accordance with a particular aspect of the method of the present invention, the above manufactured tubular member having integral solid exterior protrusions then is employed in the method disclosed in the above U.S. Pat. No. 4,663,812, the disclosure of which is hereby incorporated by reference. Particularly, the integral solid exterior protrusions on the tubular member are reshaped into hollow risers by performance of a reverse impact extrusion process as disclosed in the above U.S. Pat. No. 4,663,812, and as particularly illustrated in FIG. 3 thereof. Thereafter, apertures are formed in the wall of the tubular member at positions connecting the interior of the tubular member with the hollow risers, as disclosed in the above U.S. Pat. No. 4,663,812, and particularly in the manner illustrated in FIG. 5 thereof.

The hollow element, particularly extruded, may have a circular outer configuration in transverse cross section, with a non-circular inner configuration. Also, the hollow element may have a non-circular transverse cross-sectional configuration, for example a polygonal configuration. It is to be understood herein that the term tubular member is not limited to a member having a circular cross-sectional configuration.

The wall of the hollow member may be of substantially uniform thickness circumferentially except for the thicker wall portion. Further, the hollow element may have plural longitudinally extending thicker portions. In such an arrangement, the die may have plural arrangements of voids, such that plural arrangements of integral solid exterior protrusions are formed.

The hollow element may be formed of various materials, but it particularly is contemplated that a metal or metallic material, such as aluminum or an aluminum alloy, will be employed.

The exterior solid protrusions are spaced axially of the tubular member. In one preferred arrangement, these solid protrusions are aligned in an axial row. When the hollow element is provided with plural thickened wall portions, the resultant solid protrusions may be aligned in plural axial rows spaced circumferentially of each other. Also in a preferred arrangement, the solid protrusions are in the form of cylindrical stubs, and when such stubs thereafter are subjected to a reverse impact extrusion process in accordance with U.S. Pat. No. 4,663,812, the resultant hollow risers will be of cylindrical configuration.

It also is to be understood that the hollow element may be provided with plural interior passages therethrough, for example as disclosed in U.S. Pat. No. 4,663,812 and as particularly illustrated in FIG. 1 thereof.

BRIEF DESCRIPTION OF THE DRAWINGS

The above and other objects, features and advantages of the present invention will be apparent from the following detailed description, taken in conjunction with the accompanying drawings, wherein.

DETAILED DESCRIPTION OF THE INVENTION

Figure 1:
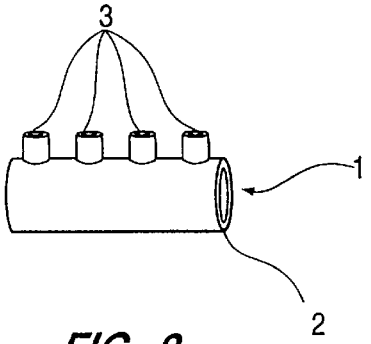
FIG. 1 is a perspective fragmentary view of a portion of a fluid conduit resulting from a particular application of the method in accordance with the present invention.
Figure 2:
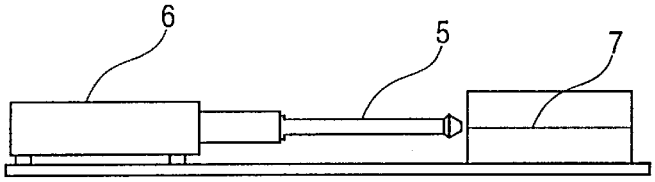
FIG. 2 is a schematic elevation view illustrating various structures that may be employed in carrying out a basic process in accordance with the manufacturing method of the present invention.

Shown in FIG. 1 is a perspective fragmentary view of a fluid conduit manufactured in accordance with a particular application of the method of the present invention. Particularly, a manifold 1, for example for use in a heat exchanger, is in the form of a tubular member 2 having extending from the exterior thereof a number of integral protrusions in the form of longitudinally spaced hollow risers 3. These risers form contacts or rest surfaces for the connection thereto of branch tubes (not shown) to ensure a circulation path within, for example, a heat exchanger. The formation of the manifold 1 will be discussed in more detail below.

Figure 4A:
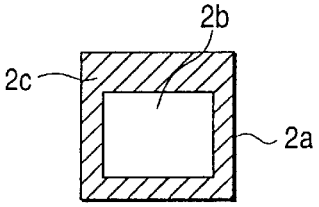
FIGS. 4*a*–4*c* are cross sectional views, taken along line IV—IV of FIG. 3, illustrating various hollow element configurations that may be employed in carrying out manufacturing methods in accordance with the present invention.
Figure 4B:
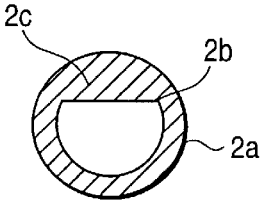
Figure 4C:
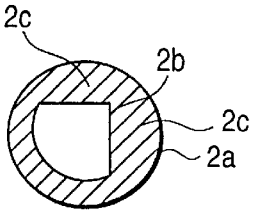

More particularly, there is provided a hollow element having a suitable cross-sectional configuration, and in any case having an axially extending interior defined by a surrounding wall having a thickness that varies circumferentially of the hollow element. Preferably such hollow element is extruded in the form of an integral member, that may have a number of desired cross-sectional configurations. Examples are illustrated in FIGS. 4*a*–4*c*. Thus, hollow element 2*a* in FIG. 4*a* has a polygonal cross-sectional configuration, for example rectangular or square as illustrated. Hollow member 2*a* has therethrough an axial interior 2*b* defined by a surrounding wall having a thickness that varies circumferentially. Particularly, the wall of the hollow member 2*a* is substantially uniform except for a longitudinally extending thickened portion 2*c*. In FIG. 4*b*, the hollow element has a circular exterior configuration and a non-circular interior 2*b* that defines a somewhat sector-shaped thickened portion 2*c*. FIG. 4*c* illustrates a variant of the embodiment of FIG. 4*b*, but wherein there are provided two thickened wall portions 2*c*.

Figure 3:
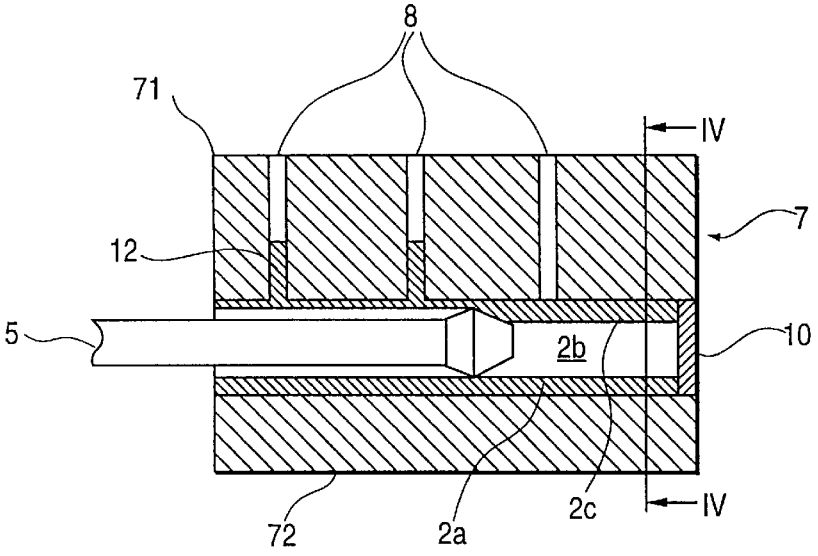
FIG. 3 is an enlarged fragmentary sectional view schematically illustrating the basic process included in the manufacturing method of the present invention.

The hollow element 2*a* of a desired configuration, for example any of the configurations illustrated in FIGS. 4*a*–4*c* or other suitable configurations, is positioned within a die 7, for example formed of mating die components 71, 72 that may be assembled to define a die interior. One of the die components, for example component 71 as illustrated in FIG. 3, has formed therein a plurality of lateral voids 8 that communicate with the die interior. When the hollow element 2*a* is positioned within the die interior, the longitudinally extending thickened portion 2*c* is positioned in alignment with voids 8. A mandrel 5 is forced to penetrate, for example by means of a hydraulic cylinder 6, through the hollow interior 2*b* of the hollow element 2*a*. The mandrel 5 has an exterior configuration complementary to the desired or intended interior configuration of the finished tubular member 2. The mandrel 5 is sequentially forced to penetrate through interior 2*b*, with the result that the hollow element 2*a* is subjected at the interior 2*b* thereof to an axially sequential deformation. More particularly, the forced penetration of the mandrel 5 causes a non-elastic flow of the material of the thicker portion 2*c* in lateral directions into voids 8 in die 7. This flow of the material of the portion 2*c* is achieved axially sequentially into voids 8, such that the flow of material into voids 8 forms integral solid protrusions 12 in such voids. It is to be understood that the size of the die interior and the size of the hollow element 2*a*, as well as the surplus of material thereof in thicker portion 2*c*, will be determined to achieve the desired sized finished tubular member and the desired sized integral exterior protrusions thereon. One skilled in the art would understand from the present disclosure how to achieve such desired sizing, taking into account a number of factors, for example the desired diameter, number and height of the required solid protrusions 12.

The penetration of mandrel 5 into the interior of the hollow element 2*a* creates the deformation pressure both axially and transversely to the thicker portion 2*c*. This sequential or gradual penetration by mandrel 5 creates the formation sequentially of integral solid risers 12. Simultaneously with the formation of protrusions 12, the penetration of the mandrel achieves a calibration of the interior configuration of the resultant tubular member. It will be understood that the mandrel 5 may have a circular configuration or any other desired configuration based on the configuration of the hollow element 2*a*, for example a polygonal mandrel configuration.

The product resulting from the above discussed operation is a tubular member having integral exterior protrusions, and such product may be employed for a number of uses. One particularly contemplated use is as the intermediate product disclosed in U.S. Pat. No. 4,663,812 and as particularly illustrated in solid lines in FIG. 3 thereof. Such product may be further treated in accordance with the present invention to result in the formation of a fluid conduit having extending laterally therefrom integral, exterior hollow risers. For example, such product may have the solid protrusions 12 thereof reshaped into hollow risers 3 by a reverse impact extrusion process, as disclosed in U.S. Pat. No. 4,663,812 and as particularly illustrated in the leftmost portion of FIG. 3 thereof. Thereafter, apertures may be formed in the wall of the resultant tubular member at positions connecting the interior thereof with at least some of the hollow risers 3, also as disclosed in U.S. Pat. No. 4,663,812 and as particularly illustrated in FIG. 5 thereof.

It is to be understood however that the scope of the present invention contemplates that some of the solid protrusions 12 and/or some of the hollow risers 3 may be employed for other purposes, for example as structure for enabling fastening or support of the hollow member. Also, it is to be understood that the formation of solid protrusions 12 into hollow risers 3 may be achieved in a different fixture or could be achieved in die 7.

It further is to be understood that the exterior surface of the tubular member 2 will be formed in accordance with the present invention to not require a subsequent machining operation. Thus, the junctions between such surface and the surfaces of protrusions 12/hollow risers 3 will be sharp, thereby facilitating attachment to other structures, for example tubing.

It will be apparent from the foregoing that the method in accordance with the present invention results in substantial advantages compared to previously known manufacturing methods. Such advantages include material savings, reduced capital expenditure due to the need for equipment capable of generating a lower pressure compared to pressures in the prior art, and reduced maintenance costs. Furthermore, less handling operations are required, handling of removed material after machining is not necessary, and a deburring operation is not necessary. Yet further, tighter tolerances are achieved on the tubular member prior to the reverse impact extrusion operation.

Although the present invention has been described and illustrated with respect to preferred features and embodiments thereof, it is to be understood that various modifications and changes may be made to the specifically described and illustrated features without departing from the scope of the present invention. It particularly is contemplated that the method of the present invention may be employed for the production of structural frame members, for example for vehicles or other constructions. Such tubular members may be employed as connectors to eliminate the use of individual cast members conventionally employed for joining of structural members into a vehicle frame. The tubular members in accordance with the present invention furthermore substantially facilitate the application of various adhesives for such connection in view of the provision of suitable and adequate support surfaces in contemplated joint areas. Also, welded connections can be achieved at positions such that welded joints will be at frame areas less subject to stress.

I claim:

1. A method of manufacturing a tubular member having integral exterior protrusions, said method comprising:

providing a hollow element having therein an axially extending interior defined by a surrounding wall having a thickness varying circumferentially, said providing comprising extruding said hollow element to have at least one axially extending said thicker wall portion, a circular outer configuration in transverse cross section, and a non-circular inner configuration;

positioning said hollow element within a die having therein lateral voids; and subjecting said hollow element at said interior thereof to deformation pressure by sequentially forcing a member through said interior of said hollow element and thereby causing a non-elastic forced flow of material of a thicker portion of said wall in an axial direction and then in lateral directions outwardly into said voids in said die, thus forming said hollow element into a tubular member having on the exterior thereof a plurality of solid protrusions that are spaced axially of said tubular member and that are not continuous circumferentially of said tubular member.

2. A method as claimed in claim 1, wherein said wall is of substantially uniform thickness circumferentially except for said thicker portion.

3. A method as claimed in claim 1, wherein said extruded hollow element has plural axially extending thicker portions.

4. A method as claimed in claim 1, wherein said extruded hollow element is formed of metal.

5. A method as claimed in claim 4, wherein said metal is aluminum alloy.

6. A method as claimed in claim 1, wherein said member comprises a mandrel and said sequentially forcing comprises moving said mandrel through said interior of said hollow element in a direction axially only thereof.

7. A method as claimed in claim 6, wherein said mandrel has an exterior configuration complementary to an interior configuration of said tubular member.

8. A method as claimed in claim 7, wherein said exterior configuration of said mandrel, over at least a portion of the length thereof, is circular in transverse cross section, such that said interior configuration of said tubular member is formed to be circular in transverse cross section.

9. A method as claimed in claim 1, wherein said solid protrusions are aligned in an axial row.

10. A method as claimed in claim 1, wherein said solid protrusions are aligned in plural axial rows spaced circumferentially.

11. A method as claimed in claim 1, wherein said solid protrusions are cylindrical stubs.

12. A method as claimed in claim 1 for the manufacture of a fluid circuit, particularly for an integral manifold, further comprising reshaping at least some of said solid protrusions into hollow risers by a reverse impact extrusion process.

13. A method as claimed in claim 12, further comprising providing apertures in the wall of said tubular member at positions connecting the interior of said tubular member with at least some of said hollow risers.

14. A method as claimed in claim 12, wherein said hollow risers are formed to be of cylindrical configuration.

15. A method of manufacturing a tubular member having integral exterior protrusions, said method comprising:

providing a hollow element having therein an axially extending interior defined by a surrounding wall having a thickness varying circumferentially, said providing comprising extruding said hollow element to have at least one axially extending said thicker wall portion, and said wall being of substantially uniform thickness circumferentially except for said thicker portion;

positioning said hollow element within a die having therein lateral voids; and subjecting said hollow element at said interior thereof to deformation pressure by sequentially forcing a member through said interior of said hollow element and thereby causing a non-elastic forced flow of material of a thicker portion of said wall in an axial direction and then in lateral directions outwardly into said voids in said die, thus forming said hollow element into a tubular member having on the exterior thereof a plurality of solid protrusions that are spaced axially of said tubular member and that are not continuous circumferentially of said tubular member.

16. A method as claimed in claim 15, wherein said extruded hollow element has a circular outer configuration in transverse cross section.

17. A method as claimed in claim 15, wherein said extruded hollow element has a non-circular transverse cross-sectional configuration.

18. A method as claimed in claim 17, wherein said configuration is polygonal.

19. A method as claimed in claim 15, wherein said extruded hollow element has plural axially extending thicker portions.

20. A method as claimed in claim 15, wherein said extruded hollow element is formed of metal.

21. A method as claimed in claim 20, wherein said metal is aluminum alloy.

22. A method as claimed in claim 15, wherein said member comprises a mandrel and said sequentially forcing comprises moving said mandrel through said interior of said hollow element in a direction axially only thereof.

23. A method as claimed in claim 22, wherein said mandrel has an exterior configuration complementary to an interior configuration of said tubular member.

24. A method as claimed in claim 23, wherein said exterior configuration of said mandrel, over at least a portion of the length thereof, is circular in transverse cross section, such that said interior configuration of said tubular member is formed to be circular in transverse cross section.

25. A method as claimed in claim 15, wherein said solid protrusions are aligned in an axial row.

26. A method as claimed in claim 15, wherein said solid protrusions are aligned in plural axial rows spaced circumferentially.

27. A method as claimed in claim 15, wherein said solid protrusions are cylindrical stubs.

28. A method as claimed in claim 15 for the manufacture of a fluid circuit, particularly for an integral manifold, further comprising reshaping at least some of said solid protrusions into hollow risers by a reverse impact extrusion process.

29. A method as claimed in claim 28, further comprising providing apertures in the wall of said tubular member at positions connecting the interior of said tubular member with at least some of said hollow risers.

30. A method as claimed in claim 28, wherein said hollow risers are formed to be of cylindrical configuration.

31. A method of manufacturing a tubular member having integral exterior protrusions, said method comprising:

providing a hollow element having therein an axially extending interior defined by a surrounding wall having a thickness varying circumferentially, said element having a circular outer configuration in transverse cross section and a non-circular inner configuration;

positioning said hollow element within a die having therein lateral voids; and subjecting said hollow element at said interior thereof to deformation pressure by sequentially forcing a member through said interior of said hollow element and thereby causing a non-elastic forced flow of material of a thicker portion of said wall in an axial direction and then in lateral directions outwardly into said voids in said die, thus forming said hollow element into a tubular member having on the exterior thereof a plurality of solid protrusions that are spaced axially of said tubular member and that are not continuous circumferentially of said tubular member.

32. A method as claimed in claim 31 wherein said wall is of substantially uniform thickness circumferentially except for said thicker portion.

33. A method as claimed in claim 31, wherein said hollow element has plural axially extending thicker portions.

34. A method as claimed in claim 31, wherein said hollow element is formed of metal.

35. A method as claimed in claim 34, wherein said metal is aluminum alloy.

36. A method as claimed in claim 31, wherein said member comprises a mandrel and said sequentially forcing comprises moving said mandrel through said interior of said hollow element in a direction axially only thereof.

37. A method as claimed in claim 36, wherein said mandrel has an exterior configuration complementary to an interior configuration of said tubular member.

38. A method as claimed in claim 37, wherein said exterior configuration of said mandrel, over at least a portion of the length thereof, is circular in transverse cross section, such that said interior configuration of said tubular member is formed to be circular in transverse cross section.

39. A method as claimed in claim 31, wherein said solid protrusions are aligned in an axial row.

40. A method as claimed in claim 31, wherein said solid protrusions are aligned in plural axial rows spaced circumferentially.

41. A method as claimed in claim 31, wherein said solid protrusions are cylindrical stubs.

42. A method as claimed in claim 31 for the manufacture of a fluid circuit, particularly for an integral manifold, further comprising reshaping at least some of said solid protrusions into hollow risers by a reverse impact extrusion process.

43. A method as claimed in claim 42, further comprising providing apertures in the wall of said tubular member at positions connecting the interior of said tubular member with at least some of said hollow risers.

44. A method as claimed in claim 42, wherein said hollow risers are formed to be of cylindrical configuration.

45. A method of manufacturing a tubular member having integral exterior protrusions, said method comprising:

providing a hollow element having therein an axially extending interior defined by a surrounding wall having a thickness varying circumferentially, said wall being of substantially uniform thickness circumferentially except for said thicker portion;

positioning said hollow element within a die having therein lateral voids; and subjecting said hollow element at said interior thereof to deformation pressure by sequentially forcing a member through said interior of said hollow element and thereby causing a non-elastic forced flow of material of a thicker portion of said wall in an axial direction and then in lateral directions outwardly into said voids in said die, thus forming said hollow element into a tubular member having on the exterior thereof a plurality of solid protrusions that are spaced axially of said tubular member and that are not continuous circumferentially of said tubular member.

46. A method as claimed in claim 45, wherein said hollow element has a circular outer configuration in transverse cross section.

47. A method as claimed in claim 45, wherein said hollow element has a non-circular transverse cross-sectional configuration.

48. A method as claimed in claim 47, wherein said configuration is polygonal.

49. A method as claimed in claim 45, wherein said hollow element has plural axially extending thicker portions.

50. A method as claimed in claim 45, wherein said hollow element is formed of metal.

51. A method as claimed in claim 50, wherein said metal is aluminum alloy.

52. A method as claimed in claim 45, wherein said member comprises a mandrel and said sequentially forcing comprises moving said mandrel through said interior of said hollow element in a direction axially only thereof.

53. A method as claimed in claim 52, wherein said mandrel has an exterior configuration complementary to an interior configuration of said tubular member.

54. A method as claimed in claim 53, wherein said exterior configuration of said mandrel, over at least a portion of the length thereof, is circular in transverse cross section, such that said interior configuration of said tubular member is formed to be circular in transverse cross section.

55. A method as claimed in claim 45, wherein said solid protrusions are aligned in an axial row.

56. A method as claimed in claim 45, wherein said solid protrusions are aligned in plural axial rows spaced circumferentially.

57. A method as claimed in claim 45, wherein said solid protrusions are cylindrical stubs.

58. A method as claimed in claim 45 for the manufacture of a fluid circuit, particularly for an integral manifold, further comprising reshaping at least some of said solid protrusions into hollow risers by a reverse impact extrusion process.

59. A method as claimed in claim 58, further comprising providing apertures in the wall of said tubular member at positions connecting the interior of said tubular member with at least some of said hollow risers.

60. A method as claimed in claim 58, wherein said hollow risers are formed to be of cylindrical configuration.

* * * * *